US006511208B1

(12) United States Patent
Kotovsky

(10) Patent No.: US 6,511,208 B1
(45) **Date of Patent: *Jan. 28, 2003**

(54) METHOD AND APPARATUS FOR LIGHTING

(76) Inventor: Irwin Kotovsky, 3941 Califonria Ave., Pittsburgh, PA (US) 15212

( * ) Notice: Subject to any disclaimer, the term of this patent is extended or adjusted under 35 U.S.C. 154(b) by 0 days.

This patent is subject to a terminal disclaimer.

(21) Appl. No.: 09/344,977

(22) Filed: Jun. 25, 1999

Related U.S. Application Data

(63) Continuation-in-part of application No. 09/161,252, filed on Sep. 26, 1998.

(51) Int. Cl.[7] ..... F21V 9/00

(52) U.S. Cl. ..... 362/285; 362/293; 362/147; 362/371; 362/404; 362/418; 362/426; 362/427

(58) Field of Search ..... 362/285, 287, 362/289, 293, 364, 365, 368, 147, 404, 418, 419, 427, 428, 426, 371

(56) References Cited

U.S. PATENT DOCUMENTS 5,432,683 A * 7/1995 Brown ..... 362/16
5,690,420 A * 11/1997 Saldana, Sr. ..... 362/275
6,170,965 B1 * 1/2001 Kotovsky ..... 362/371

* cited by examiner

*Primary Examiner*—Sandra O'Shea
*Assistant Examiner*—John Anthony Ward
(74) *Attorney, Agent, or Firm*—Ansel M. Schwartz

(57) ABSTRACT

A lighting apparatus. The apparatus includes a first mechanism for holding a lamp. The apparatus includes a media. The apparatus includes a second mechanism for holding the media to the first holding mechanism. The second mechanism is removably attachable to the first mechanism. The media is removably attachable to the second mechanism so the media will not separate from the second mechanism when the second mechanism is separated from the first mechanism. A lighting apparatus. The apparatus includes a mounting structure. The apparatus includes a gimbal ring assembly for holding a lamp. The gimbal ring assembly has a first axis and a second axis perpendicular with the first axis. The gimbal ring assembly is rotatable about the first axis and about the second axis. The gimbal ring assembly is connected to the mounting structure. The apparatus includes a locking mechanism for locking the gimbal ring assembly in a fixed position relative to the first axis, to the second axis and the mounting structure. The apparatus includes a second mechanism for holding media to the gimbal assembly. The second mechanism is removably attachable to the gimbal assembly. The media is removably attachable to the second mechanism so the media will not separate from the second mechanism when the second mechanism is separated from the first mechanism. A method for installing lighting.

29 Claims, 8 Drawing Sheets

METHOD AND APPARATUS FOR LIGHTING

This is a continuation-in-part of application Ser. No. 09/161,252, filed Sep. 26, 1998.

FIELD OF THE INVENTION

The present invention is related to a lighting apparatus having a gimbal assembly with at least one ring to hold a lamp. More specifically, the present invention is related to a lighting apparatus having a cone with a media that is removably attachable to the cone so the media will not separate from the cone when the cone is separated from the ring.

BACKGROUND OF THE INVENTION

In many situations, lighting is used not only to illuminate an area to bring attention to an area, but to create a lighting effect on an area. To do this, the lamp is carefully chosen to focus on a specific area. This means that when a gimbal assembly is used, the ring or rings must be carefully positioned to achieve the aforementioned results. The gimbal assembly is then left alone until the lamp held by the gimbal assembly simply needs to be changed. When this happens, the ring or rings are jarred and moved from their previously set position. After the lamp is replaced, the ring or rings must be reset. In many instances, where the lamp is in the ceiling, this is not always simple. Also, the persons responsible for changing the lamp may not be qualified to properly refocus the lamp and gimbal assembly. The present invention avoids having to reset the gimbal assembly after the lamp is changed.

Furthermore, it is common for a cone with media, such as fitter media, to be attached with the gimbal assembly. When the cone is removed from the gimbal assembly, the media is loose and can separate from the cone. In situations such as high ceilings or tight and narrowed areas, the separation of the media from the cone adds to the difficulty of changing the lamp. The present invention provides for the media to remain secure to the cone when the cone is separated from the gimbal assembly.

SUMMARY OF THE INVENTION

The present invention pertains to a lighting apparatus. The lighting apparatus comprises a mounting structure. The apparatus comprises a gimbal ring assembly for holding a lamp. The gimbal ring assembly has a first axis and a second axis perpendicular with the first axis. The gimbal ring assembly is rotatable about the first axis and about the second axis. The gimbal ring assembly is connected to the mounting structure. The apparatus comprises a locking mechanism for locking the gimbal ring assembly in a fixed position relative to the first axis, to the second axis and the mounting structure.

The present invention pertains to a lighting apparatus. The lighting apparatus comprises a yoke. The apparatus comprises a lamp ring for holding a lamp. The lamp ring is connected to the mounting structure. The apparatus comprises a ring locking mechanism for locking the lamp ring in a fixed position relative to the yoke.

The present invention pertains to a method for lighting. The method comprises the steps of attaching a mounting structure to a ceiling. Then there is the step of orienting an outer ring of a gimbal ring assembly at a first position relative to a second axis of the gimbal ring assembly. Next there is the step of locking the outer ring in place relative to the mounting structure. Then there is the step of orienting an inner ring having a lamp of the gimbal ring assembly at a second position relative to a first axis of the gimbal ring assembly. Next there is the step of locking the inner ring assembly to the outer ring assembly.

The present invention pertains to a lighting apparatus. The apparatus comprises a first mechanism for holding a lamp. The apparatus comprises a media. The apparatus comprises a second mechanism for holding the media to the first holding mechanism. The second mechanism is removably attachable to the first mechanism. The media is removably attachable to the second mechanism so the media will not separate from the second mechanism when the second mechanism is separated from the first mechanism.

The present invention pertains to a lighting apparatus. The apparatus comprises a mounting structure. The apparatus comprises a gimbal ring assembly for holding a lamp. The gimbal ring assembly has a first axis and a second axis perpendicular with the first axis. The gimbal ring assembly is rotatable about the first axis and about the second axis. The gimbal ring assembly is connected to the mounting structure. The apparatus comprises a locking mechanism for locking the gimbal ring assembly in a fixed position relative to the first axis, to the second axis and the mounting structure. The apparatus comprises a second mechanism for holding media to the gimbal assembly. The second mechanism is removably attachable to the gimbal assembly. The media is removably attachable to the second mechanism so the media will not separate from the second mechanism when the second mechanism is separated from the first mechanism.

The present invention pertains to a method for installing lighting. The method comprises the steps of placing a media into a second mechanism for holding the media. Then there is the step of inserting a media retaining spring over the media and the second mechanism. Next there is the step of fixing the second mechanism to a first mechanism holding a lamp.

BRIEF DESCRIPTION OF THE DRAWINGS

In the accompanying drawings, the preferred embodiment of the invention and preferred methods of practicing the invention are illustrated in which.

DETAILED DESCRIPTION

Figure 1:
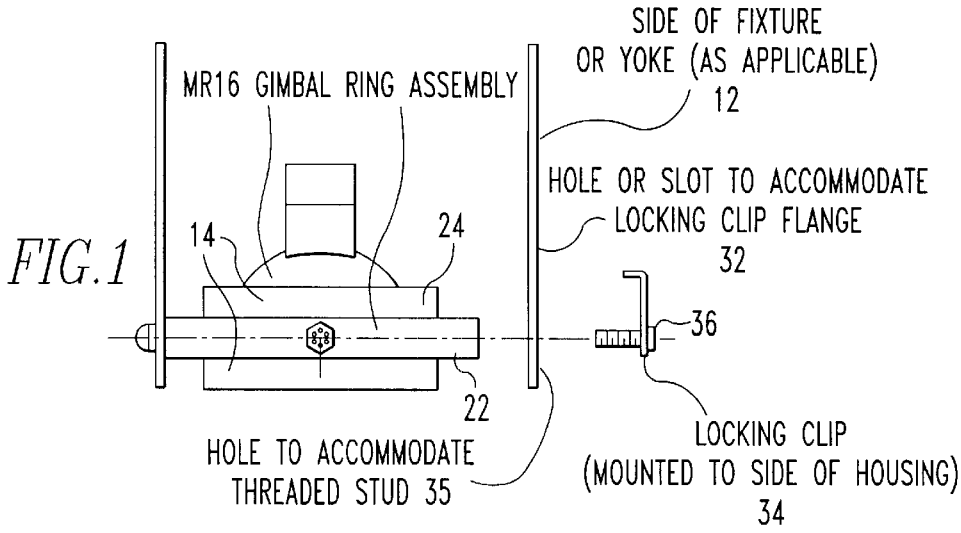
FIG. 1 is an end view of a lighting apparatus of the present invention.
Figure 2:
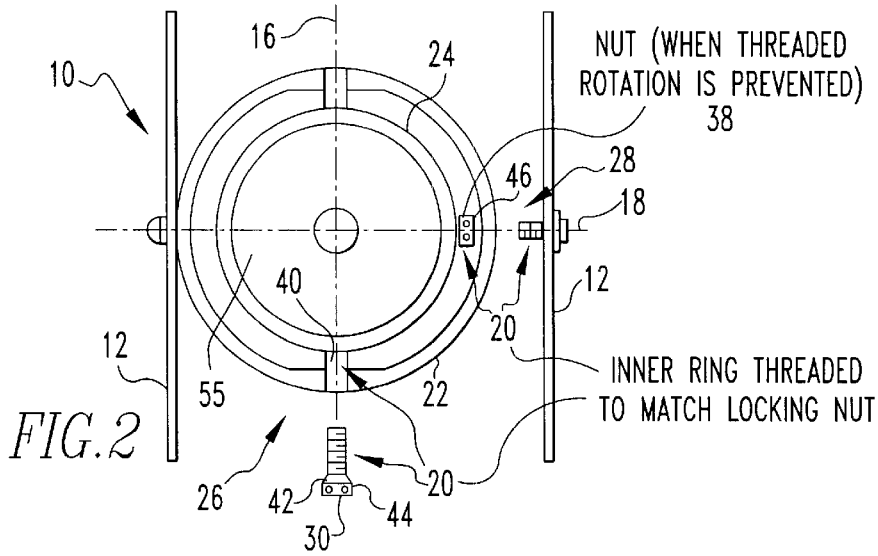
FIG. 2 is a bottom view of a lighting apparatus of the present invention.
Figure 3:
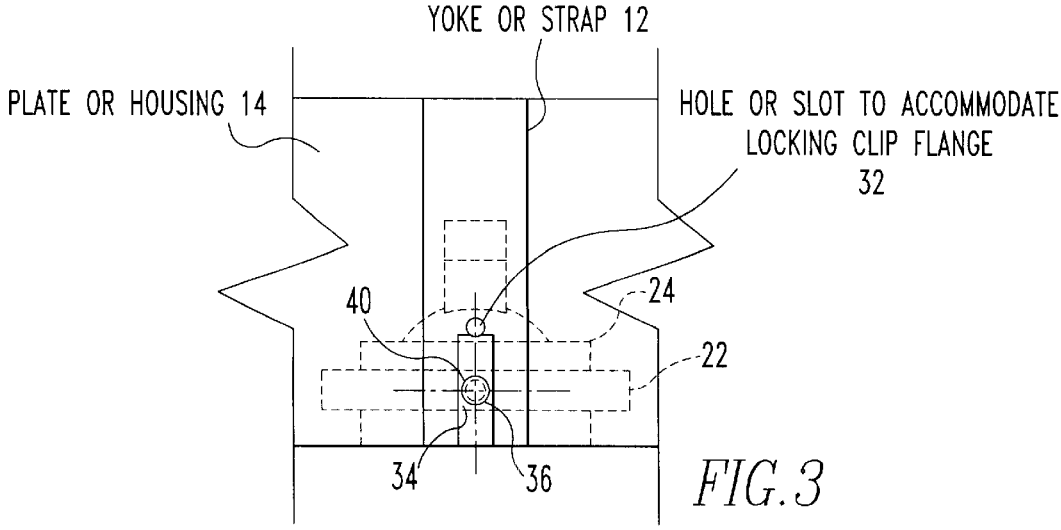
FIG. 3 is a side view of a lighting apparatus of the present invention.

Referring now to the drawings wherein like reference numerals refer to similar or identical parts throughout the several views, and more specifically to FIGS. 1, 2 and 3 thereof, there is shown a lighting apparatus 10. The lighting apparatus 10 comprises a mounting structure 12. The apparatus comprises a gimbal ring assembly 14 for holding a lamp 55. The gimbal ring assembly 14 has a first axis 16 and a second axis 18 perpendicular with the first axis 16. The gimbal ring assembly 14 is rotatable about the first axis 16 and about the second axis 18. The gimbal ring assembly 14 is connected to the mounting structure 12. The apparatus comprises a locking mechanism 20 for locking the gimbal ring assembly 14 in a fixed position relative to the first axis 16, to the second axis 18 and the mounting structure 12.

Preferably, the gimbal ring assembly 14 comprises an outer ring 22 and an inner ring 24. The outer ring 22 is disposed about the inner ring 24.

Figure 9:
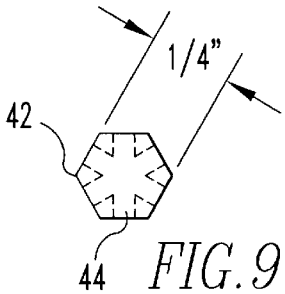
FIG. 9 is a top view of a locking threaded screw or stud.
Figure 8:
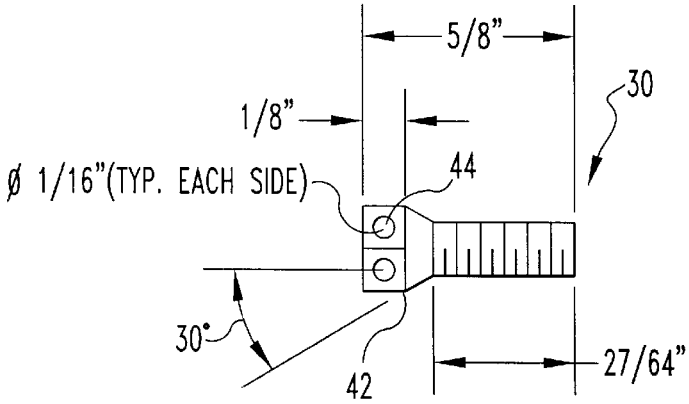
FIG. 8 is a side view of a locking threaded screw or stud.
Figure 10:
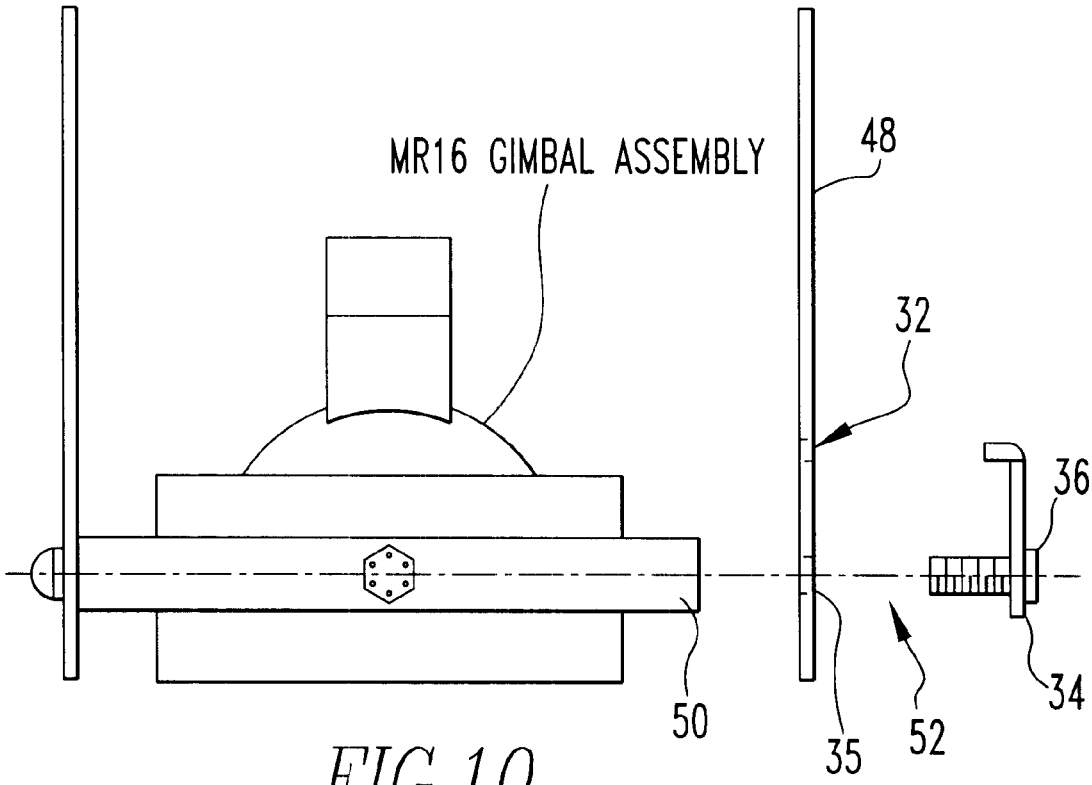
FIG. 10 is an end view of an alternative embodiment of a lighting apparatus of the present invention.

The locking mechanism 20 preferably includes a first lock mechanism 26 which locks the inner ring 24 to the outer ring 22 relative to the first axis 16. The first lock mechanism 26 preferably includes a first locking threaded screw or stud 30, as shown in FIGS. 8 and 9, that contacts the outer ring 22 and the inner ring 24.

Figure 4:
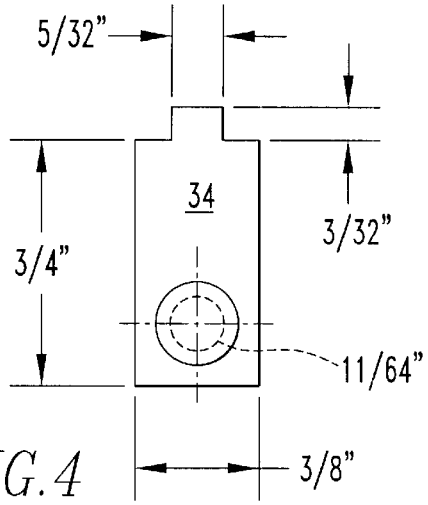
FIG. 4 is a front view of a locking clip with threaded stud or screw.
Figure 6:
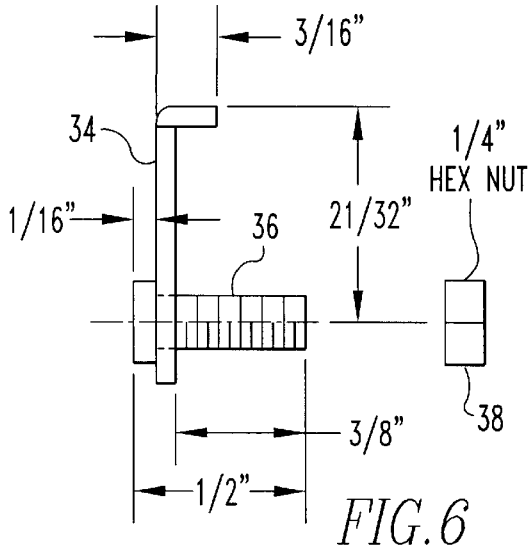
FIG. 6 is a side view of a locking clip with threaded stud or screw.
Figure 5:
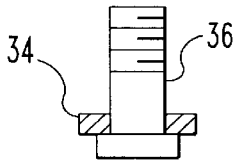
FIG. 5 is a top view of a locking clip with threaded stud or screw.

Preferably, the locking mechanism 20 includes a second lock mechanism 28 which locks the outer ring 22 to the mounting structure 12 relative to the second axis 18. Preferably, the mounting structure 12 includes a slot 32 and the second lock mechanism 28 includes a locking clip 34, as shown in FIGS. 4–6, which engages the mounting structure 12 through the hole or slot 32. Preferably, the second lock mechanism 28 includes a second threaded screw or stud 36 that extends through the mounting structure 12 via the locking clip 34 and contacts the outer ring 22.

Figure 7:
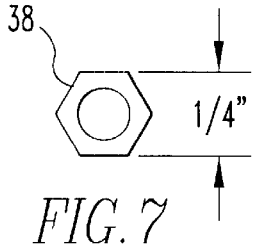
FIG. 7 is a top view of an inner nut.
Figure 7A:
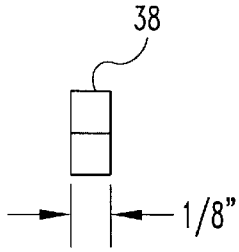

The second lock mechanism 28 preferably includes an inner nut 38, as shown in FIGS. 6 and 7, disposed between the inner ring 24 and upper ring. The second threaded screw or stud 36 extends through the outer ring 22 and contacts the inner nut 38 which holds the second threaded screw or stud 36 in place so the outer ring 22 cannot rotate about the second axis 18. Preferably, the inner nut 38 has an inner head 46 with holes 44 which are adapted to receive a tool to tighten or loosen the second threaded screw or stud 36 from the nut 38.

Preferably, the inner ring 24 has a threaded hole 40 which receives the first locking threaded screw or stud 30 so the first locking threaded screw or stud 30 holds the inner ring 24 and outer ring 22 together and prevents their moving relative to each other about the first axis 16. The first locking threaded screw or stud 30 preferably has a locking head 42 with holes 44 which are adapted to receive a tool to tighten or loosen the first locking threaded screw or stud 30.

The present invention pertains to a lighting apparatus 10. The lighting apparatus 10 comprises a yoke 48. The apparatus comprises a lamp ring 50 for holding a lamp 55. The lamp ring 50 is connected to the mounting structure 12. The apparatus comprises a ring locking mechanism 52 for locking the lamp ring 50 in a fixed position relative to the yoke 48.

Preferably, the yoke 48 includes a hole or slot 32 and the ring locking mechanism 52 includes a locking clip 34 which engages the yoke 48 through the slot 32. Preferably, the ring locking mechanism 52 includes a second threaded screw or stud 36 that extends through the yoke 48 via the locking clip 34 and contacts the outer ring 22. The ring locking mechanism 52 preferably includes an inner nut 38 disposed in the lamp ring 50. The second threaded screw or stud 36 extends through the lamp ring 50 and contacts the inner nut 38 which holds the second threaded screw or stud 36 in place so the lamp ring 50 cannot rotate relative to the yoke 48.

The present invention pertains to a method for lighting. The method comprises the steps of attaching a mounting structure 12 to a ceiling. Then there is the step of orienting an outer ring 22 of a gimbal ring assembly 14 at a first position relative to a second axis 18 of the gimbal ring assembly 14. Next there is the step of locking the outer ring 22 in place relative to the mounting structure 12. Then there is the step of orienting an inner ring 24 having a lamp 55 of the gimbal ring assembly 14 at a second position relative to a first axis 16 of the gimbal ring assembly 14. Next there is the step of locking the inner ring 24 assembly to the outer ring 22 assembly.

Preferably, after the locking the inner ring 24 step, there is the step of changing the lamp 55 of the inner ring 24 without the position of the inner ring 24 or outer ring 22 changing.

In the operation of the preferred embodiment, a lighting apparatus 10 is placed in a ceiling. This placement occurs by fixing the mounting structure 12 to the ceiling as is well known in the art. In the mounting structure 12 is a gimbal ring assembly 14. The gimbal ring assembly 14 is comprised of an outer ring 22 and an inner ring 24. The gimbal ring assembly can be a standard MR16 gimbal ring assembly available from Modular International, Inc. of Pittsburgh, Pa. The inner ring 24 holds a lamp. The inner ring 24 is rotatably connected to the outer ring 22 and the inner ring 24 is able to rotate about a first axis 16 of the gimbal ring assembly 14. The outer ring 22 is rotatably attached to the mounting structure 12, as is well known in the art, so that the outer ring 22 can rotate about a second axis 18.

A first locking threaded screw or stud 30 is screwed through a hole in the outer ring 22 and further threaded into a threaded hole 40 in the inner ring 24. When the first locking threaded screw or stud 30 is tightened, it screws through the hole in the outer ring 22 and screws in to the threaded hole 40 in the inner ring 24 where it fixes the outer ring 22 with the inner ring 24 so the inner ring 24 cannot move or rotate. After the outer ring 22 is placed in a desired position relative to the second axis, the first locking threaded screw or stud 30 is tightened to fix the inner ring 24 in place so the lamp remains focused and fixed in place in a desired direction.

The outer ring 22 is fixed in place after it is rotated to a desired position relative to the second axis 18 by a locking clip 34 first being mounted to the side of the mounting structure 12 through a hole or slot 32 in the mounting structure 12. A second threaded screw or stud 36 extends through the locking clip 34 and through a locking clip hole 35 so it extends into the interior of the mounting structure 12.

The second threaded screw or stud 36 is screwed through a hole in the outer ring 22 that is aligned with the locking clip hole 35 until it threads into an inner nut 38. The inner nut 38 is disposed between the inner ring 24 and the outer ring 22. When the second threaded screw or stud 36 is tightened into the inner nut 38, the outer ring 22 becomes held by the threaded stud in place relative to the mounting structure 12 and the second axis 18.

The locking nut 38 can have a locking head 42 with holes 44 which receive a tool, such as an Allen wrench, to facilitate tightening or loosening of the second threaded screw or stud 36. Similarly, the inner nut 38 can have an inner head 46 with holes 44 for the same purpose to facilitate tightening or loosening.

The advantage of the present invention is that it allows the inner ring 24 and outer ring 22 to be fixed in place once the lamp is in the desired position. Whenever the lamp burns out or needs to be changed for whatever reason, whether it be a day, a week, a month or a year later, the lamp can be changed without any concern of disturbing the position the lamp is held in by the gimbal ring assembly. This is because the inner ring 24 and outer ring 22 have become fixed in place through the use of the second threaded screw or stud 36, locking clip 34, inner nut 38, first locking threaded screw or stud 30 and threaded hole 40.

In a similar manner, a yoke 48 which only has a lamp ring 50 can have a locking clip 34 attached to the yoke 48. The second threaded screw or stud 36 can then be used with an inner nut 38 to hold the lamp ring 50 in place, for the same reason, as described above.

Figure 18:
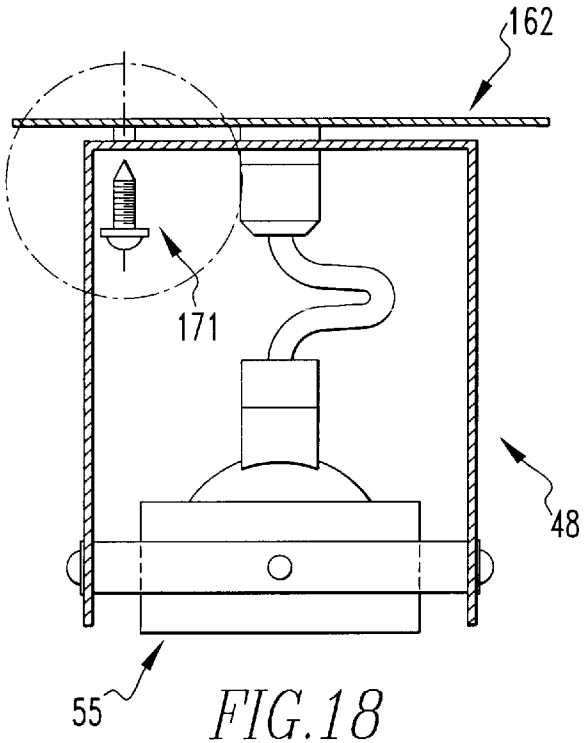
FIG. 18 is a schematic representation of a side view of a yoke locked to a housing with a self-tapping screw.
Figure 19:
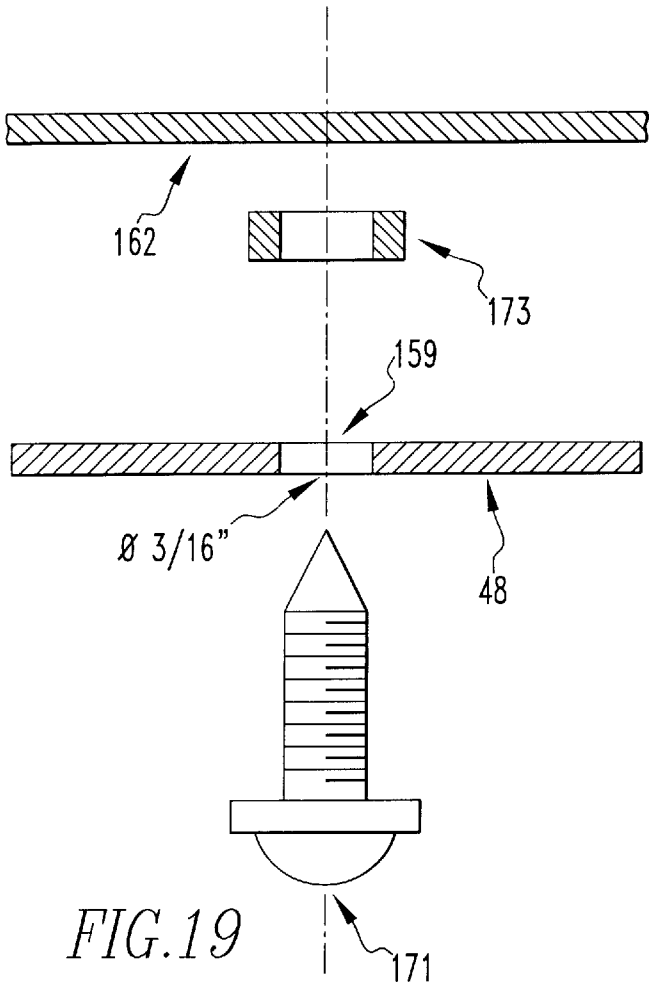
FIG. 19 is a schematic representation of an exploded view of a self-tapping screw and a spacer.

The yoke 48 can be locked in place to the housing 162 with a yoke screw 157 that extends throughout a yoke hole 159 and threads into a bushing mechanism 161 that clamps to the housing 162 in a housing slot 163, as shown in the FIGS. of 15, 16 and 17. The bushing mechanism 161 comprises an upper bushing 168 with a threaded hole that is disposed above the housing 162 in which the yoke screw 157 threads into, and a lower bushing 169 with a hole disposed on the bottom of the housing 162 which mates with the upper bushing 168. The lower bushing 169 essentially acts as a spacer between the yoke 48 and the housing 162, when the yoke screw 157 is threaded into the threaded hole of the upper bushing 168. In such an instance, the bushing mechanism 161 squeezes the housing 162 and the yoke is tightened and locked by the yoke screw 159 in place. The yoke is positioned and locked prior to the installation of the lamp. Alternatively, the self-tapping screw 171 can extend through the yoke hole 159, through a spacer 173, and pierce the housing 162 to lock the yoke 48 in place, as shown in FIGS. 18 and 19.

The present invention pertains to a lighting apparatus 60, as shown in FIGS. 11–14. The apparatus 60 comprises a first mechanism 61 for holding a lamp 62. The apparatus 60 comprises a media 63. The apparatus 60 comprises a second mechanism 64 for holding the media 63 to the first mechanism 61. The second mechanism 64 is removably attachable to the first mechanism 61. The media 63 is removably attachable to the second mechanism 64 so the media 63 will not separate from the second mechanism 64 when the second mechanism 64 is separated from the first mechanism 61.

Preferably, the second mechanism 64 includes a first portion 65 that engages with the first mechanism 61 and a second portion 66 which extends from the first portion 65. The media 63 is preferably a filter media 63 which is disposed in the first portion 65. Preferably, the second portion 66 includes a cone 67.

The first portion 65 preferably includes a twist and lock pin assembly 68 which extends from the outer surface of the first portion 65 which engages with the first mechanism 61. Preferably, the first mechanism 61 includes a first groove 69 in which the twist and lock pin assembly 68 engages.

The first portion 65 preferably includes a second groove 70 disposed in its inner surface and a media retaining spring 71 which is disposed in the second groove 70 to hold the media 63 to the second mechanism 64 so the media 63 cannot come out of the second mechanism 64. The media 63 is disposed between the cone 67 and the media retaining spring 71. Preferably, the first mechanism 61 includes a third groove 72 disposed on its inner surface and a second retaining spring 77 which is disposed in the third groove 72 to hold the lamp 62 to the first mechanism 61.

Figure 13:
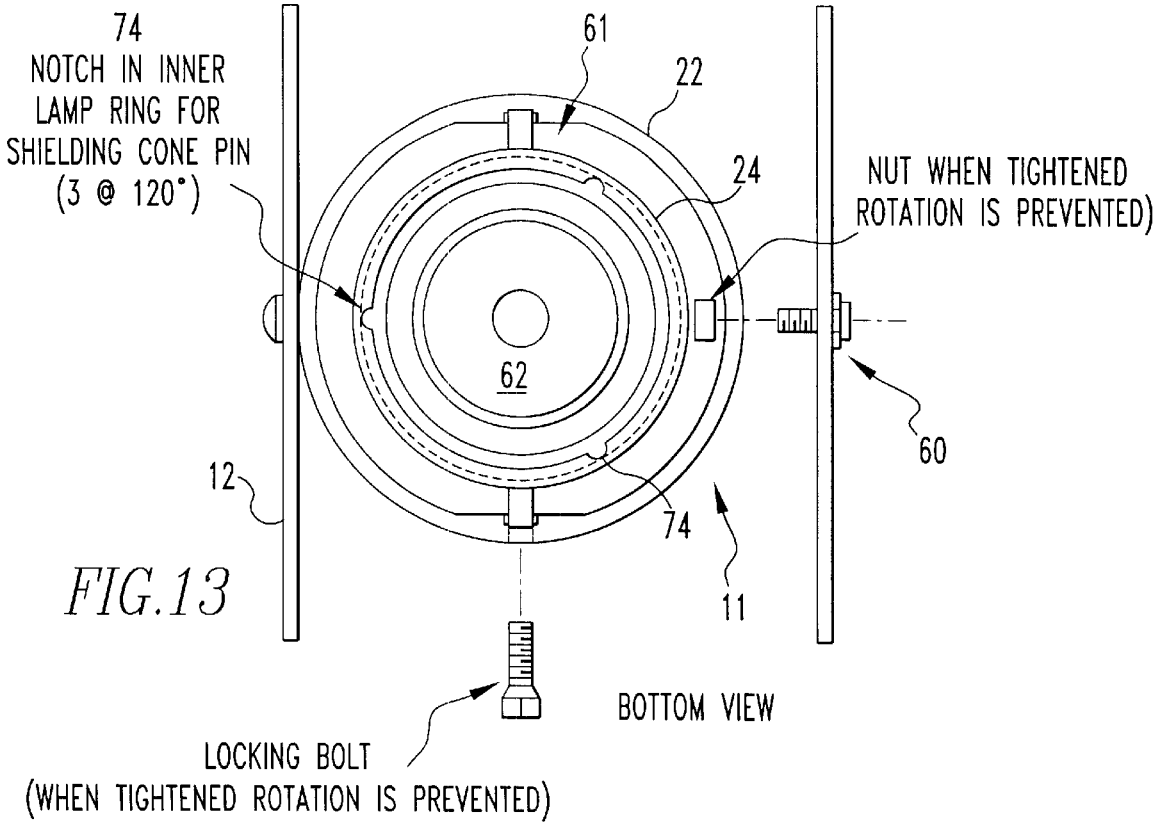
FIG. 13 is a bottom view of a lamp ring and cone.
Figure 17:
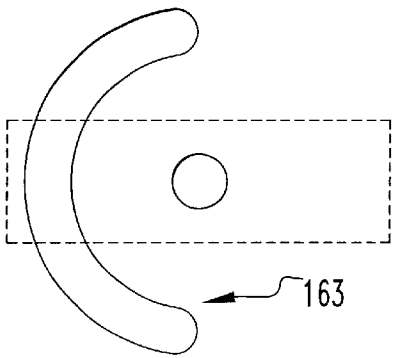
FIG. 17 is a schematic representation of an overhead view of the housing with a slot.
Figure 15:
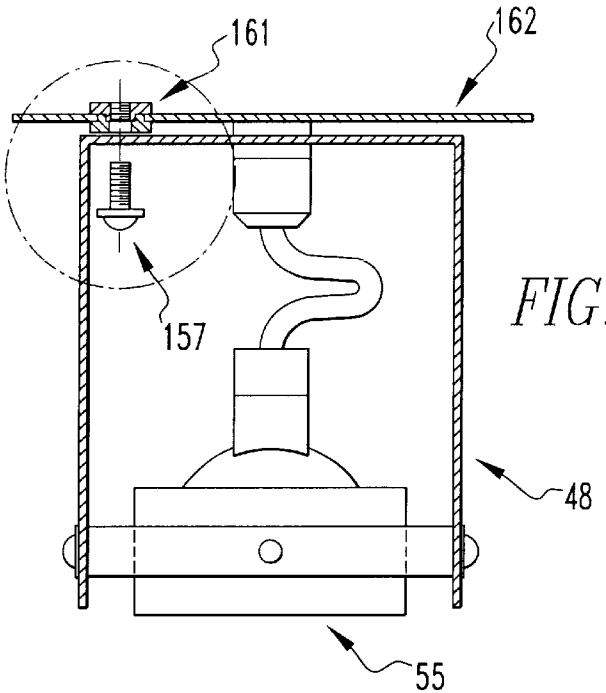
FIG. 15 is a schematic representation of a side view of a yoke locked to a housing with a yoke screw.
Figure 16:
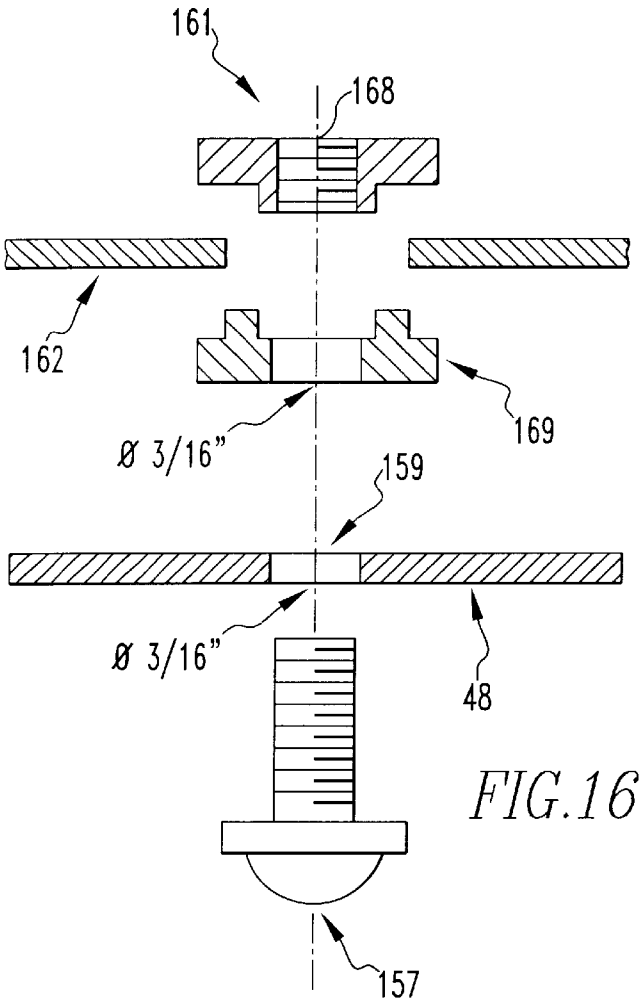
FIG. 16 is a schematic representation of an exploded view of a yoke screw and bushing mechanism.

The apparatus 60 preferably includes a pressure spring 73 disposed over the lamp 62 between the lamp 62 and the second mechanism 64 which maintains pressure on the first portion 65 to maintain the second mechanism 64 firmly in place via the twist and lock pin assembly 68 in the first groove 69. Preferably, the first mechanism 61 has notches 74, as shown in FIG. 13, through which the twist and lock pin assembly 68 access the first groove 69. The first mechanism 61 preferably includes a bolt assembly 75 disposed on its outer surface.

Preferably, the apparatus 60 includes an outer ring 22 which holds the first mechanism 61. The bolt assembly 75 locks the first mechanism 61 to the outer ring 22. The apparatus 60 preferably includes a mounting structure 12 which holds the outer ring 22. Preferably, the apparatus 60 includes a locking mechanism for locking the outer ring 22 to the mounting structure 12. The first mechanism 61 preferably includes an inner ring 24. Preferably, the apparatus 60 includes n additional filter media 63 disposed in the second portion 66, where n is greater than or equal to 1 and is and integer.

Figure 14:
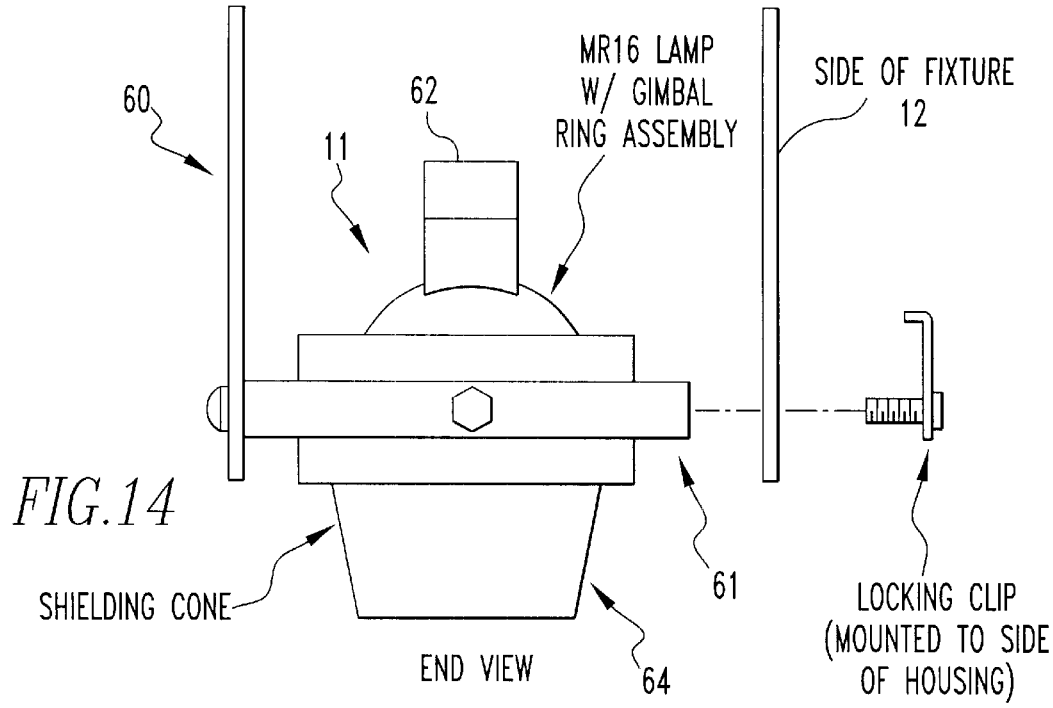
FIG. 14 is an end view of a lamp ring and cone in a mounting structure.

The present invention pertains to a lighting apparatus 60, as shown in FIGS. 13 and 14. The apparatus 60 comprises a mounting structure 12. The apparatus 60 comprises a gimbal ring assembly 11 for holding a lamp 62. The gimbal ring assembly 11 has a first axis and a second axis perpendicular with the first axis. The gimbal ring assembly 11 is rotatable about the first axis and about the second axis. The gimbal ring assembly 11 is connected to the mounting structure 12. The apparatus 60 comprises a locking mechanism for locking the gimbal ring assembly 11 in a fixed position relative to the first axis, to the second axis and the mounting structure 12. The apparatus 60 comprises a second mechanism 64 for holding media 63 to the gimbal assembly. The second mechanism 64 is removably attachable to the gimbal assembly. The media 63 is removably attachable to the second mechanism 64 so the media 63 will not separate from the second mechanism 64 when the second mechanism 64 is separated from the first mechanism 61.

The present invention pertains to a method for installing lighting. The method comprises the steps of placing a media 63 into a second mechanism 64 for holding the media 63. Then there is the step of inserting a media 63 retaining spring over the media 63 and the second mechanism 64. Next there is the step of fixing the second mechanism 64 to a first mechanism 61 holding a lamp 62.

Preferably, after the fixing step, there are the steps of removing the second mechanism 64 from the first mechanism 61 and rotating the second mechanism 64 so the media 63 faces ground without the media 63 separating from the second mechanism 64 due to the media 63 retaining spring holding it in the second mechanism 64. The first mechanism 61 preferably includes an inner ring 24, the second mechanism 64 includes a cone 67 and after the fixing step, there are the steps of locking the inner ring 24 to an outer ring 22, locking the outer ring 22 to a mounting structure 12 and attaching the mounting structure 12 to a building structure.

Figure 11:
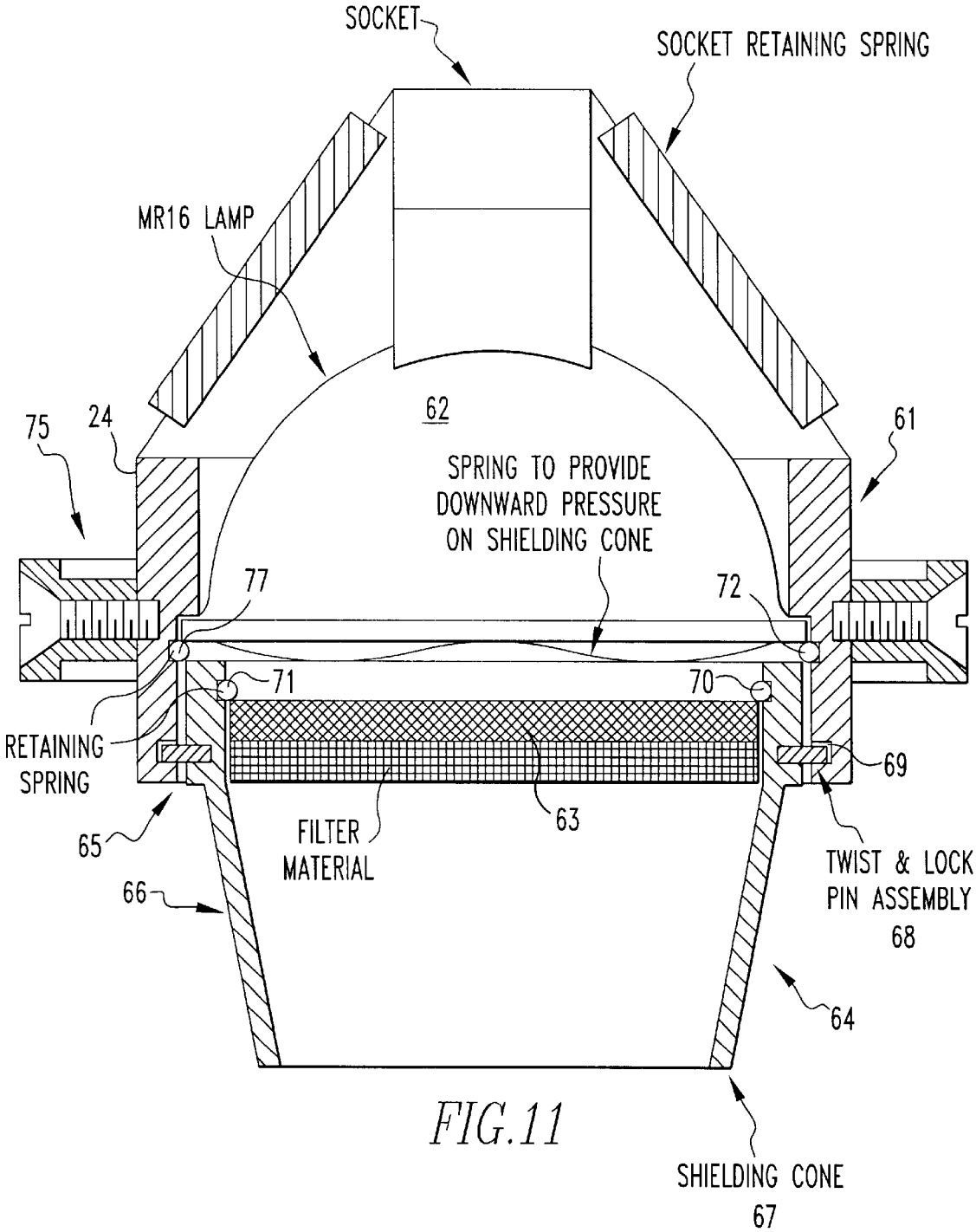
FIG. 11 is a side view of a lighting apparatus of the present invention with a cone and media.
Figure 12:
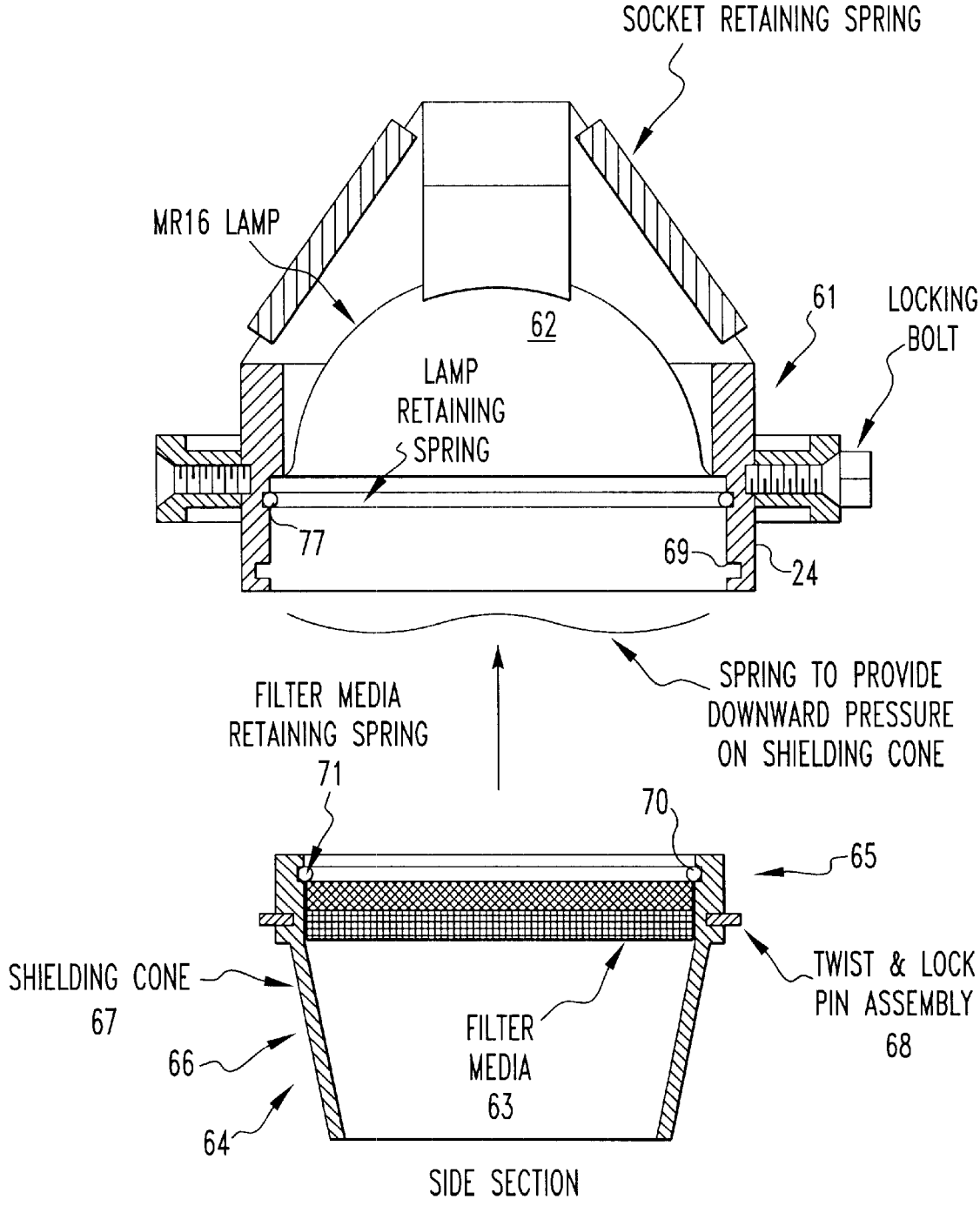
FIG. 12 is a side sectional view of a lamp ring and cone.

In the operation of the preferred embodiment, a first filter media 63*a* is inserted into the first portion 65 of a cone 67 and a second filter media 63*b* is placed on top of the first filter media 63 in the cone 67, as shown in FIGS. 11 and 12. A filter media retaining ring 71 is then inserted into a first groove 69 on the inner surface of the first portion 65 of the cone 67. The pins 76 of the twist and lock pin assembly 68 are then aligned with notches 74 in an inner ring 24 which holds a lamp 62, as shown in FIG. 13. The notches 74 extend axially from the edge of the inner ring 24 to a second groove 70 which extends circumferentially about the inner surface of the inner ring 24. When the pins 76 of the twist and lock pin assembly 68 are moved to the second groove 70 along the notches 74, the cone 67 is then rotated sideways so the pins 76 of the twist and lock pin assembly 68 are out of alignment with the notches 74 so the cone 67 cannot fall back out to of the notches 74 and separate from the inner ring 24.

The inner ring 24 has a lamp 62 inserted into it and a second retaining spring 77 inserted over the lamp 62 into a third groove 72 to hold the lamp 62 to the inner ring 24. A pressure spring 73 is then inserted over the lamp 62 in the inner ring 24 to maintain downward pressure on the cone 67 when the cone 67 is fitted into the inner ring 24 to maintain the cone 67 firmly in stable in fixed to the inner ring 24. On the outer surface of the inner ring 24, is a bolt assembly 75 for receiving locking bolts from an outer ring 22 or from a mounting structure 12 to fix the inner ring 24 in place, as described above, and as shown in FIGS. 13 and 14.

When the cone 67 is desired to be removed, the cone 67 is simply rotated in an opposite direction to when the cone 67 was rotated to seat the cone 67 in the inner ring 24 so the pins 76 of the pin assembly 68 align with the notches 74. The cone 67 is then pulled away from the inner ring 24, with the pins 76 moving along the notches 74 until the cone 67 is separated from the inner ring 24. In this way, the cone 67 can be separated without affecting the position of the inner ring 24 so there does not have to be any concern of having to realign the position of the inner ring 24 and thus the lamp 62 during the changing process.

With a filter media 63 retaining spring disposed in the first portion 65 over the filter media 63, there is no concern that the filter media 63 will fall out during the changing process. This is most expressly appreciated when the lamp 62 is disposed in a high or out of the way location where it is not easy to place the filter media 63 back into the cone 67 if the filter media 63 was to have fallen out.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A lighting system for building structure comprising:

a first mechanism for holding a lamp;

a mounting structure mounting the first mechanism to the building structure, the first mechanism connected to the mounting structure;

a media; and a second mechanism for holding the media to the first holding mechanism, said second mechanism removably attachable to the first mechanism, said media removably attachable to said second mechanism so the media will not separate from the second mechanism when the second mechanism is separated from the first mechanism.

2. A system as described in claim 1 wherein the first mechanism is rotatably connected to the building structure.

3. A system as described in claim 2 wherein a second mechanism includes a first portion that engages with the first mechanism and the second portion which extends from the first portion.

4. A system as described in claim 3 wherein the first mechanism includes a gimbal ring assembly for holding a lamp, the gimbal ring assembly has a first axis and a second axis perpendicular with the first axis, the gimbal ring assembly is rotatable about the first axis and about the second axis, the gimbal ring assembly is connected to the mounting structure.

5. A system as described in claim 4 wherein the media is a filter media which is disposed in the first portion.

6. A system as described in claim 5 wherein the second portion includes a cone.

7. A system as described in claim 6 wherein the first portion includes a twist and lock pin assembly which extends from the outer surface of the first portion which engages with the first mechanism.

8. A system as described in claim 7 wherein the first mechanism includes a first groove in which the twist and lock pin assembly engages.

9. A system as described in claim 8 wherein the first portion includes a second groove disposed in its inner surface and a media retaining spring which is disposed in the second groove to hold the media to the second mechanism so the media cannot come out of the second mechanism, said media disposed between the cone and the media retaining spring.

10. A system has described in claim 9 wherein the first mechanism includes a third groove disposed on its inner surface and a second retaining spring which is disposed in the third groove to hold the lamp to the first mechanism.

11. A system as described in claim 10 including a pressure spring disposed over the lamp between the lamp and the second mechanism which maintains pressure on the first portion to maintain the second mechanism firmly in place via the twist and lock pin assembly in the first groove.

12. A system as described in claim 11 wherein the first mechanism has notches through which the twist and lock pin assembly access the first groove.

13. A system as described in claim 12 wherein the first mechanism includes a bolt assembly disposed on its outer surface.

14. A system as described in claim 13 including an outer ring which holds the first mechanism, said bolt assembly locking the first mechanism to the outer ring.

15. A system as described in claim 14 including a mounting structure which holds the outer ring.

16. A system as described in claim 15 including a locking mechanism for locking the outer ring to the mounting structure.

17. A system as described in claim 16 wherein the first mechanism includes an inner ring.

18. A system as described in claim 17 including n additional filter media disposed in the second portion, where n is greater than or equal to 1 and is and integer.

19. A lighting apparatus for a building structure comprising:

a mounting structure;

a gimbal ring assembly for holding a lamp, the gimbal ring assembly has a first axis and a second axis perpendicular with the first axis, the gimbal ring assembly is rotatable about the first axis and about the second axis, the gimbal ring assembly is connected to the mounting structure;

a locking mechanism for locking the gimbal ring assembly in a fixed position relative to the first axis, to the second axis and the mounting structure;

a media; and a second mechanism for holding the media to the gimbal assembly, the second mechanism is removably attachable to the gimbal assembly, the media is removably attachable to the second mechanism so the media will not separate from the second mechanism when the second mechanism is separated from the gimbal-ring assembly.

20. A system as described in claim 19 wherein the second mechanism includes a first portion that engages with the gimbal ring assembly first mechanism and the second portion which extends from the first portion.

21. A system as described in claim 20 wherein the media is a filter media which is disposed in the first portion.

22. A system as described in claim 21 wherein the second portion includes a cone.

23. A system as described in claim 22 wherein the first portion includes a twist and lock pin assembly which extends from the outer surface of the first portion which engages with the first mechanism.

24. A system as described in claim 23 wherein the gimbal ring assembly includes a first groove in which the twist and lock pin assembly engages.

25. A system as described in claim 24 wherein the first portion includes a second groove disposed in its inner surface and a media retaining spring which is disposed in the second groove to hold the media to the second mechanism so the media cannot come out of the second mechanism, said media disposed between the cone and the media retaining spring.

26. A system has described in claim 25 wherein the first mechanism includes a third groove disposed on its inner surface and a second retaining spring which is disposed in the third groove to hold the lamp to the gimbal ring assembly.

27. A system as described in claim 26 including a pressure spring disposed over the lamp between the lamp and the second mechanism which maintains pressure on the first portion to maintain the second mechanism firmly in place via the twist and lock pin assembly in the first groove.

28. A system as described in claim 27 wherein the gimbal ring assembly has notches through which the twist and lock pin assembly access the first groove.

29. A system as described in claim 28 including n additional filter media disposed in the second portion, where n is greater than or equal to 1 and is and integer.

* * * * *